United States Patent [19]

Mitchell et al.

[11] 4,435,851

[45] Mar. 13, 1984

[54] FLAP HINGE FOR A SHOULDER PAD

[75] Inventors: Hal D. Mitchell; Donald R. Walker, both of Rolla, Mo.

[73] Assignee: Figgie International Inc., Willoughby, Ohio

[21] Appl. No.: 378,140

[22] Filed: May 14, 1982

[51] Int. Cl.[3] ..... A41D 13/00

[52] U.S. Cl. ..... 2/2

[58] Field of Search ..... 2/2

[56] References Cited

U.S. PATENT DOCUMENTS

| | | | |
|---|---|---|---|
| 1,489,048 | 4/1924 | Whitley | 2/2 |
| 2,196,124 | 4/1940 | Smith | 2/2 |
| 2,545,039 | 3/1951 | Mitchel | 2/2 |
| 2,957,177 | 10/1960 | Turner | 2/2 |
| 3,087,163 | 4/1963 | Kelly | 2/2 |
| 3,867,726 | 2/1975 | Owl et al. | 2/2 |
| 4,158,242 | 6/1979 | Mitchel | 2/2 |
| 4,295,227 | 10/1981 | Mitchel | 2/2 |
| 4,322,859 | 4/1982 | Mitchel | 2/2 |

*Primary Examiner*—Louis Rimrodt

*Attorney, Agent, or Firm*—Senniger, Powers, Leavitt and Roedel

[57] ABSTRACT

An improvement in a shoulder pad of the type comprising a pair of arches which overlie the inner shoulders of the wearer, and a pair of flaps which extend in front-to-back direction over the shoulders for protecting the outer parts of the shoulders. The improvement comprises a flap hinge for hinging each flap to a respective arch. The hinge includes a pair of snubber straps secured at one of their ends to a respective flap at the front and back of the flap. The straps extend from the flap under the arch to the inner edge of the arch, up around the inner edge of the arch and then over the arch back to the flap for securement at their other ends to the flap.

19 Claims, 5 Drawing Figures

FLAP HINGE FOR A SHOULDER PAD

BACKGROUND OF THE INVENTION

This invention relates generally to athletic apparel, and more particularly to a shoulder pad for football players.

Shoulder pads as conventionally designed have severely restricted the upper body movement of the athlete, particularly the upward movement of his arms and shoulders. This is due at least in part to the manner in which the shoulder flaps are attached to the arches of the shoulder pads. In the typical construction, each flap is attached to a respective arch by means of a central hinge strap and front and back snubber straps. When attached in this manner, the flap is able to move upwardly only relatively stiffly, and it also tends to lock in position before the arm is fully raised. This severely restricts an athlete's upward arm movement.

SUMMARY OF THE INVENTION

Among the several objects of this invention may be noted the provision of an improved shoulder pad which allows greater mobility of the upper body of the wearer, particularly the arms and shoulders, so that the arms may be raised without undue interference from the shoulder pad; the provision of such a shoulder pad which provides added protection for the shoulders of the wearer; and the provision of such a shoulder pad which is compact in design and durable.

Generally, this present invention relates to an improvement in a shoulder pad of the type comprising a pair of arches adapted to overlie the inner parts of the shoulders of the wearer, the arches having laterally-spaced inner edges providing an opening for the neck of the wearer, and a pair of flaps adapted to extend in front-to-back direction over the shoulders for protecting the outer parts of the shoulders. The improvement comprises a flap hinge for hinging each flap to a respective arch for enabling the flap to swing upwardly about the hinge upon upward movement of the outer part of a respective shoulder. The flap hinge comprises a first strap secured at one end to a respective flap generally adjacent the front of the flap and extending from the flap under the arch to the inner edge of the arch, up around the inner edge of the arch, and thence over the arch back to the flap for securement at its other end to the flap, and a second strap secured at one end to the flap generally adjacent the back of the flap and extending from the flap under the arch to the inner edge of the arch, up around the inner edge of the arch, and thence over the arch back to the flap for securement at its other end to the flap.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
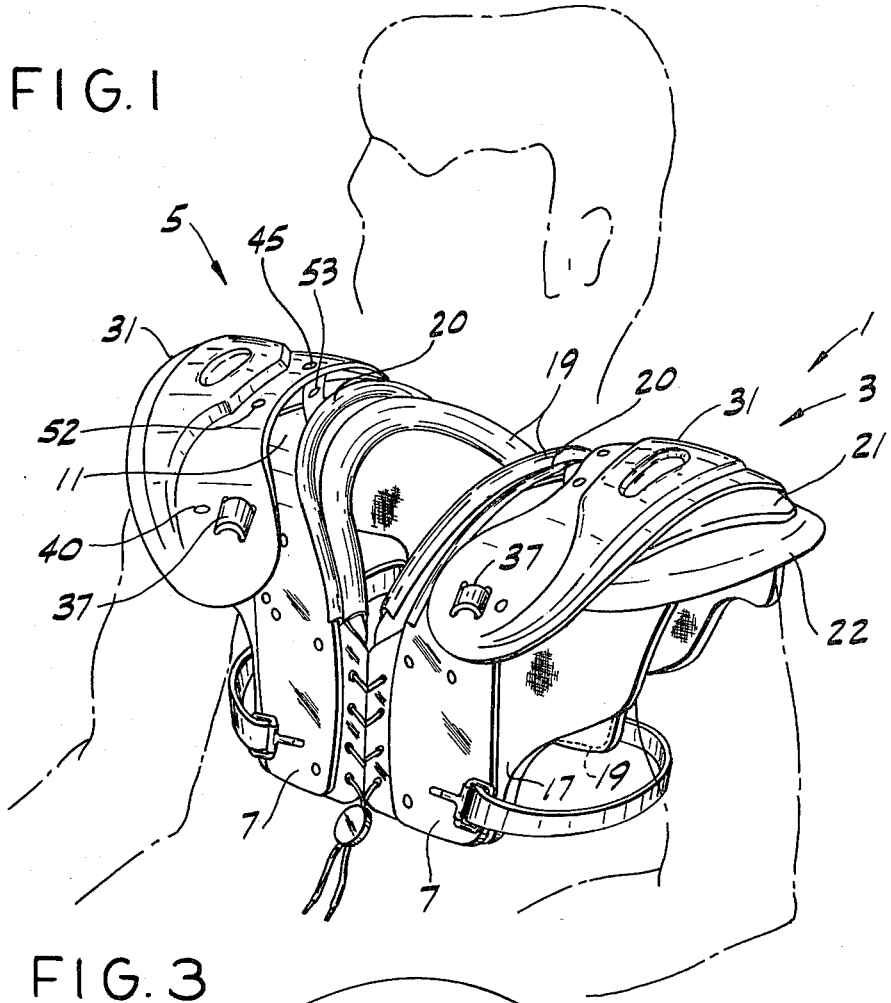
FIG. 1 is a perspective of a shoulder pad having shoulder flap hinges of the present invention.

Referring to the drawings, and more particularly to FIG. 1, a shoulder pad made according to the present invention is designated in its entirety by the reference numeral 1 and is shown worn by a football player. It comprises a left-hand body member generally indicated at 3 which fits over the left shoulder of the player and a right-hand body member generally indicated at 5 which fits over the right shoulder. These two members 3, 5 may be of a suitable relatively lightweight plastic material, such as a high density polyethylene, having a sufficiently high impact resistance to withstand the heavy blows received during the course of a football game. Each of the body members is of generally inverted U-shape as viewed from the side and consists of a chestplate 7, a backplate 9 and an arch 11 integrally connecting the plates 7, 9. The arches 11 of the two body members 3, 5 overlie the inner parts of the shoulders and have laterally-spaced inner edges which provide an opening for the neck of the wearer, the spacing between the arches being such that the arches lie adjacent and relatively close to the neck. A curved, relatively stiff member or stiffener 13, which may be made of the same plastic as the arch, extends along the underside of the arch and is affixed by rivets 15 at its ends to the arch.

For added protection, each of the body members 3, 5 has padding generally indicated at 17 secured to the inside thereof as by stitching, which padding 17 preferably comprises suitable closed-cell elastomeric vinyl foam in a stretch fabric cover. The padding 17 at the top of the arch 11 extends laterally outwardly over the shoulder beyond the arch and overlies the outer part of the shoulder. Welted neck padding 19, 20 is provided along the inner edges of the padding 17 and arch 11, respectively, adjacent the neck to assure that the neck is adequately guarded.

Figure 3:
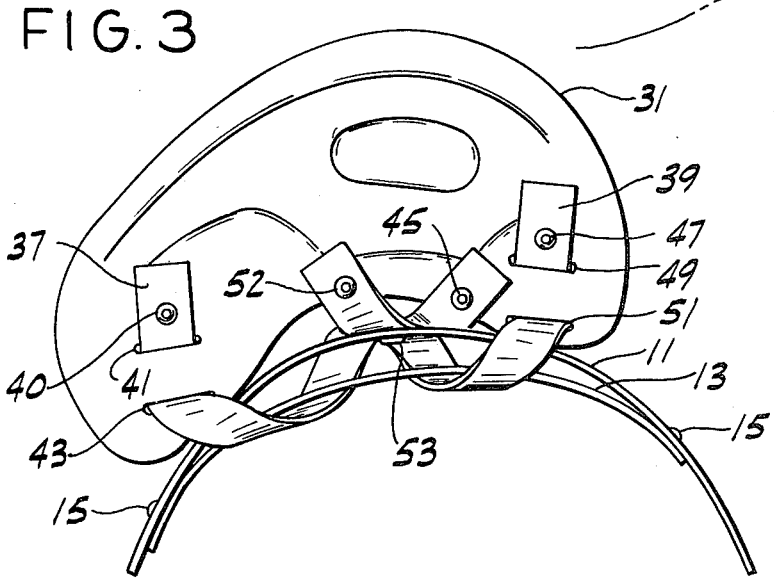
FIG. 3 is a right side elevation of FIG. 2 with the shoulder flap raised to illustrate details.

The shoulder pad 1 also includes a pair of convex caps, each designated 21, overlying the outer parts of the shoulders. These caps have padding of the same construction as padding 17 stitched to the inside thereof, as indicated at 22. A pair of substantially rigid flaps, each designated 31, extend in front-to-back direction over the shoulders and overlie caps 21, thus providing additional protection for the outer parts of the shoulders. The flaps are arched to conform to the shoulders and are disposed laterally outwardly of the inner edges of the arches, with the inner edge margins 33 of the flaps overlying the outer edge margins 35 of the arches (FIG. 3).

In accordance with this invention, each flap 31 is hingedly attached to a respective arch 11 for pivotal movement with respect thereto by means of two snubber straps, the first of which is designated 37 and the second 39. The first strap 37 is secured (e.g., riveted) at one end to the underside of the flap generally adjacent the front of the flap, as indicated at 40. From this rivet connection the strap passes up through a first slot 41 in the flap and then down through a second generally parallel slot 43 in the flap disposed generally inwardly of the first slot. Both slots 41, 43 are angled generally inwardly from front to back, with the inner slot 43 being disposed above and generally inwardly of the outer edge of the arch 11 (the right edge as viewed in FIG. 2). The strap 37 extends from slot 43 down and around the outer edge of the arch and angles generally inwardly and rearwardly therefrom under the stiffener 13 (and thus under the arch as well) to the inner edge of the stiffener, up around the inner edge of the arch, and thence over the arch and back to the flap, the other end of the strap being secured (e.g., riveted) as indicated at 45 to the underside of the flap at the inner edge margin 33 of the flap intermediate the front and back of the flap (but toward the back of the flap).

Figure 2:
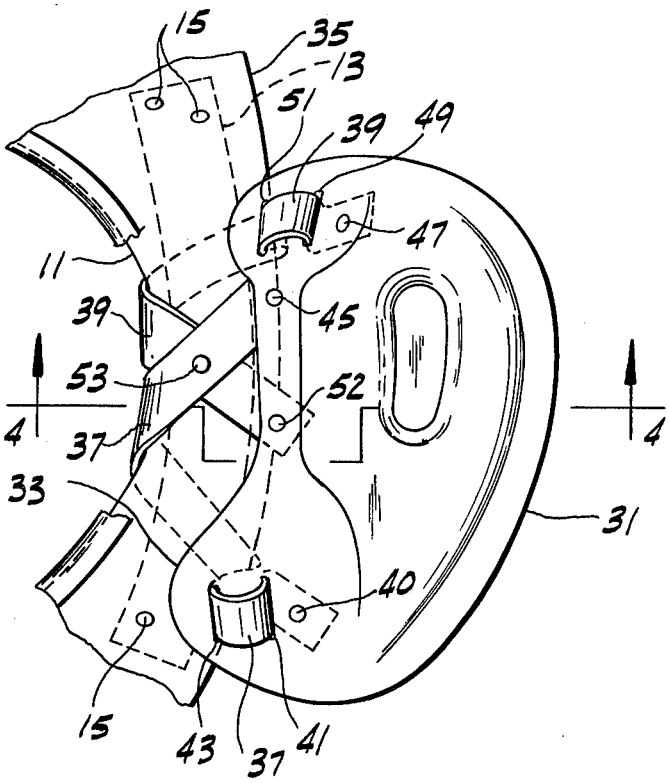
FIG. 2 is a partial plan of FIG. 1 showing a shoulder flap and the manner in which it is hinged to a respective arch by a pair of snubber straps.

The second strap 39 is secured, as by means of a rivet 47, at one end to the underside of the flap adjacent the back of the flap. From the rivet connection, the strap loops up and then down through two generally parallel slots 49, 51 in the flap, both of which slots are angled generally inwardly from back to front. As shown in FIG. 2, the inner slot 51 is located above and generally inwardly (leftwardly) of the outer (right) edge of the arch therebelow. The strap reaches down from slot 51 around the outer edge of the arch and angles generally inwardly and forwardly therefrom under the stiffener 13 (and thus under the arch) to the inner edge of the stiffener, up around the inner edge of the arch, and thence over the arch and back to the flap, the second strap 39 crossing under the first strap 37 on top of the arch. The other end of the second strap 39 is secured, as by means of a rivet 52, for example, to the underside of the flap at the inner edge margin 33 of the flap intermediate the front and back of the flap (but toward the front of the flap) forward of the rivet connection 45 between the first strap 37 and the flap. As indicated at 53, both straps 37, 39 are anchored (e.g., riveted) to the arch at the point where they cross one another on top of the arch. The configuration of the snubber straps 37, 39 and the tension therein are such that the inner edge of each flap is held relatively closely adjacent the top surface of a respective arch, with the flap extending outwardly away from the arch at an upward incline sufficient to space the outer portions of the flap above a respective cap 21.

Figure 4:
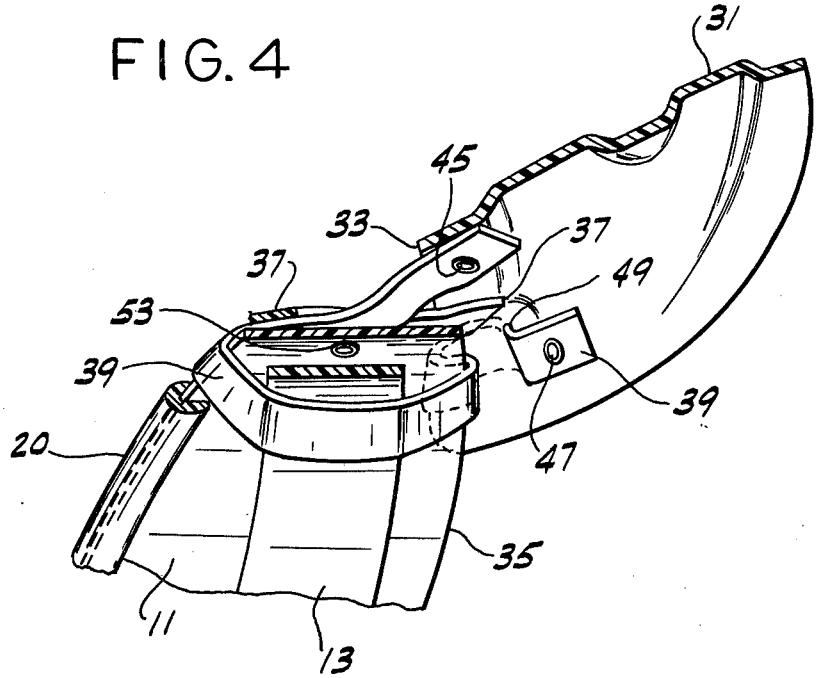
FIG. 4 is a partial vertical section on line 4—4 of FIG. 2 showing the flap in an unstressed condition.
Figure 5:
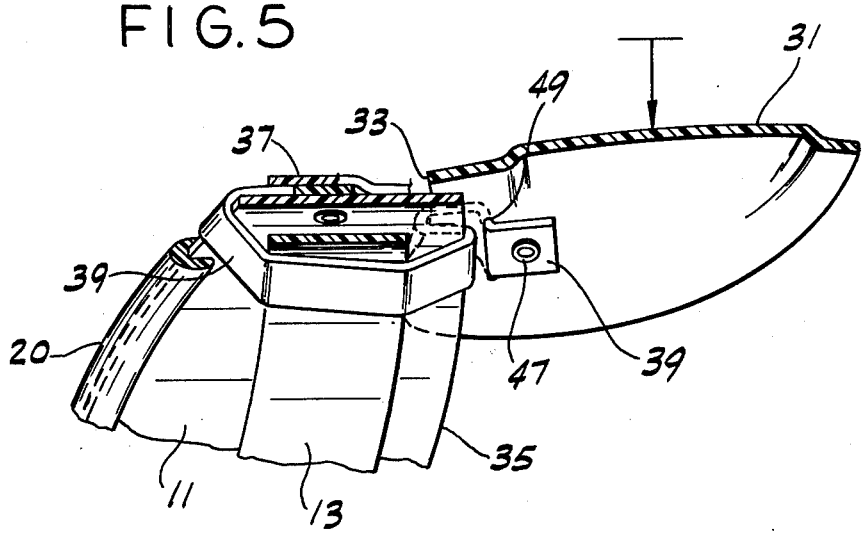
FIG. 5 is a view similar to FIG. 4 showing the flap when subjected to a downward blow.

The flap hinge (i.e., snubber-strap) arrangement described above permits the flaps 31 readily to swing upwardly upon upward movement of the outer parts of the shoulders. At the same time, however, the flaps are effective in absorbing the impact of blows delivered to the shoulders. Thus, referring to FIGS. 4 and 5, it will be noted that a downward blow on the shoulder flap 31 will cause the flap to pivot in the clockwise direction relative to the arch 11, the snubber straps 37, 39 acting as hinges. During this pivotal movement, the portion of the snubber straps looped through the slots 41, 43, 49, 51 in the flap move inwardly (leftwardly as viewed in FIGS. 4 and 5) relative to the arch 11. Moreover, since the inner two slots 43, 51 of the four slots are disposed generally inwardly of the outer edge of the arch to begin with, that is, when the flap is in its FIG. 4 position, these slots 43, 51 (and thus the portions of the straps passing downwardly therethrough) move away from the outer (right) edge of the arch as the flap pivots down. This causes the straps to tighten around the arch 11 and stiffener 13, thereby restraining the downward movement of the flap and thus absorbing the shock resulting from the blow. When the flap reaches the FIG. 5 position wherein the top of the flap is generally parallel to the top of the arch, the straps tighten to the extent that the flap becomes substantially locked in position with respect to the arch thereby to prevent any further downward movement of the outer portion of the flap toward the shoulder. Thus the shoulder is effectively protected without a substantial loss in mobility.

It will be observed from the foregoing that the improved shoulder pad 1 of this invention allows freedom of movement of the upper body and particularly of the shoulders so that the arms may be moved above a horizontal position without substantial interference from the shoulder pad. Moreover, the shoulder pad 1 is constructed effectively to absorb blows and to protect the wearer from injury. Another advantage of the pad is that it is compact yet durable and simple in design for economical manufacture and maintenance.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a shoulder pad of the type comprising a pair of arches adapted to overlie the inner parts of the shoulders of the wearer, the arches having laterally-spaced inner edges providing an opening for the neck of the wearer, and a pair of flaps adapted to extend in front-to-back direction over the shoulders for protecting the outer parts of the shoulders, an improvement comprising a flap hinge for hinging each flap to a respective arch for enabling the flap to swing upwardly about the hinge upon upward movement of the outer part of a respective shoulder, said flap hinge comprising a first strap secured at one end to a respective flap generally adjacent the front of the flap and extending from the flap under the arch to the inner edge of the arch, up around the inner edge of the arch, and thence over the arch back to the flap for securement at its other end to the flap, and a second strap secured at one end to the flap generally adjacent the back of the flap and extending from the flap under the arch to the inner edge of the arch, up around the inner edge of the arch, and thence over the arch back to the flap for securement at its other end to the flap.

2. In a shoulder pad as set forth in claim 1, said first strap angling generally inwardly and rearwardly from the front of the flap under the arch to the inner edge of the arch, up around the inner edge of the arch, and thence outwardly and rearwardly across the top of the arch to its attachment with the flap, and the second strap angling generally inwardly and forwardly from the back of the flap under the arch to the inner edge of the arch, up around the inner edge of the arch, and thence outwardly and forwardly across the top of the arch for securement to the flap, said straps crossing one another as they angle across the top of the arch toward the flap.

3. In a shoulder pad as set forth in claim 2, said first and second straps being anchored to the arch.

4. In a shoulder pad as set forth in claim 3, said first and second straps being anchored to the arch where they cross one another on top of the arch.

5. In a shoulder pad as set forth in claim 4, each shoulder flap being disposed laterally outwardly of the inner edge of a respective arch, with the inner edge margin of the flap overlying the outer edge margin of the arch.

6. In a shoulder pad as set forth in claim 5, said other ends of the straps being secured to the flap at the inner edge margin of the flap intermediate the front and back of the flap.

7. In a shoulder pad as set forth in claim 6, said other end of each strap being secured to the underside of the flap.

8. In a shoulder pad as set forth in claim 1 further comprising an elongate stiffener extending along the arch on the underside of the arch and affixed at its ends to the arch, said first and second straps extending from the front and back of a respective flap under the stiffener and thence up and around the inner edge of the arch.

9. In a shoulder pad as set forth in claim 1, said one end of each strap being secured to the underside of the flap and extending up through a first slot in the flap and then down through a second generally parallel slot in the flap disposed generally inwardly of the first slot.

10. In a shoulder pad as set forth in claim 9, said first slot being disposed, when said flap is unstressed, above and generally inwardly of the outer edge of a respective arch therebelow.

11. In a shoulder pad as set forth in claim 1, each shoulder flap being disposed laterally outwardly of the inner edge of a respective arch, with the inner edge margin of the flap overlying the outer edge margin of the arch.

12. In a shoulder pad as set forth in claim 11, said one end of each strap being secured to the underside of the flap and extending up through a first slot in the flap and then down through a second generally parallel slot in the flap disposed generally inwardly of the first slot.

13. In a shoulder pad as set forth in claim 12, said first slot being disposed, when said flap is unstressed, above and generally inwardly of the outer edge of a respective arch therebelow.

14. In a shoulder pad as set forth in claim 12, said first strap angling generally inwardly and rearwardly from the front of the flap under the arch to the inner edge of the arch, up around the inner edge of the arch, and thence outwardly and rearwardly across the top of the arch for securement to the flap, and the second strap angling generally inwardly and forwardly from the back of the flap under the arch to the inner edge of the arch, up around the inner edge of the arch, and thence outwardly and forwardly across the top of the arch for securement to the flap, said straps crossing one another as they angle across the top of the arch toward the flap.

15. In a shoulder pad as set forth in claim 14, said other ends of the straps being secured to the flap at the inner edge margin of the flap intermediate the front and back of the flap.

16. In a shoulder pad as set forth in claim 15, said other end of each strap being secured to the underside of the flap.

17. In a shoulder pad as set forth in claim 14, said first and second straps being anchored to the arch.

18. In a shoulder pad as set forth in claim 17, said first and second straps being anchored to the arch where they cross one another on top of the arch.

19. In a shoulder pad as set forth in claim 18 further comprising an elongate stiffener extending along the arch on the underside of the arch and affixed at its ends to the arch, said first and second straps extending from adjacent the front and back of a respective flap under the stiffener and thence up and around the inner edge of a respective arch.

* * * * *